US009639042B2

(12) United States Patent
Ishii et al.

(10) Patent No.: US 9,639,042 B2
(45) Date of Patent: May 2, 2017

(54) FIXING DEVICE AND IMAGE FORMING APPARATUS

(71) Applicants: Kenji Ishii, Kanagawa (JP); Susumu Matsusaka, Kanagawa (JP); Yasuhiko Ogino, Kanagawa (JP); Shohta Kobashigawa, Tokyo (JP); Kazuhito Kishi, Kanagawa (JP); Takashi Seto, Kanagawa (JP); Ippei Fujimoto, Kanagawa (JP); Kazunari Sawada, Tokyo (JP); Hiroshi Yoshinaga, Chiba (JP); Hiromasa Takagi, Tokyo (JP); Takamasa Hase, Tokyo (JP)

(72) Inventors: Kenji Ishii, Kanagawa (JP); Susumu Matsusaka, Kanagawa (JP); Yasuhiko Ogino, Kanagawa (JP); Shohta Kobashigawa, Tokyo (JP); Kazuhito Kishi, Kanagawa (JP); Takashi Seto, Kanagawa (JP); Ippei Fujimoto, Kanagawa (JP); Kazunari Sawada, Tokyo (JP); Hiroshi Yoshinaga, Chiba (JP); Hiromasa Takagi, Tokyo (JP); Takamasa Hase, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/063,755

(22) Filed: Mar. 8, 2016

(65) Prior Publication Data

US 2016/0274514 A1 Sep. 22, 2016

(30) Foreign Application Priority Data

Mar. 16, 2015 (JP) ..... 2015-052248
Jan. 21, 2016 (JP) ..... 2016-010038

(51) Int. Cl.
*G03G 15/20* (2006.01)

(52) U.S. Cl.
CPC ..... *G03G 15/2053* (2013.01); *G03G 15/2082* (2013.01); *G03G 2215/2035* (2013.01)

(58) Field of Classification Search
CPC ..... G03G 15/20142; G03G 15/2053; G03G 15/2082; G03G 2215/2016; G03G 2215/2035
(Continued)

(56) References Cited

U.S. PATENT DOCUMENTS 8,774,666 B2 * 7/2014 Saito ..... G03G 15/2042 399/334
2011/0058864 A1 3/2011 Fujimoto et al.
(Continued)

FOREIGN PATENT DOCUMENTS

JP 2011-237831 11/2011
JP 2012-141328 7/2012
(Continued)

*Primary Examiner* — Sophia S Chen
(74) *Attorney, Agent, or Firm* — Oblon, McClelland, Maier & Neustadt, L.L.P.

(57) ABSTRACT

A fixing device includes a nip formation pad to press against a fixing rotator. A primary heater is disposed opposite the fixing rotator in a primary heating span spanning in an axial direction of the fixing rotator to heat the primary heating span of the fixing rotator from which heat is conducted to the nip formation pad with a primary conduction. A secondary heater is disposed opposite the fixing rotator in a secondary heating span that is outboard from the primary heating span in the axial direction of the fixing rotator. The secondary heater is interposed between a first nip formation portion and a second nip formation portion of the nip formation pad to heat the secondary heating span of the fixing rotator through the nip formation pad from which heat is conducted to the fixing rotator with a secondary conduction greater than the primary conduction.

20 Claims, 8 Drawing Sheets

(58) Field of Classification Search
USPC ..... 399/329, 330, 333, 334
See application file for complete search history.

(56) References Cited

U.S. PATENT DOCUMENTS

| | | | | |
|---|---|---|---|---|
| 2012/0155935 | A1 | 6/2012 | Yoshikawa et al. | |
| 2013/0188977 | A1* | 7/2013 | Hase ..... | G03G 15/2042 399/334 X |
| 2013/0251430 | A1 | 9/2013 | Fujimoto et al. | |
| 2014/0356036 | A1 | 12/2014 | Shimokawa et al. | |
| 2014/0356037 | A1 | 12/2014 | Shimokawa et al. | |
| 2015/0125193 | A1* | 5/2015 | Ishii ..... | G03G 15/2042 399/329 |
| 2015/0185671 | A1 | 7/2015 | Ikebuchi et al. | |
| 2015/0355586 | A1 | 12/2015 | Fujimoto et al. | |
| 2016/0011550 | A1* | 1/2016 | Utsunomiya ..... | G03G 15/2053 399/329 |
| 2016/0187823 | A1* | 6/2016 | Seto ..... | G03G 15/2082 399/329 |

FOREIGN PATENT DOCUMENTS

| | | |
|---|---|---|
| JP | 2012-159865 | 8/2012 |
| JP | 2014-178370 | 9/2014 |

* cited by examiner

FIXING DEVICE AND IMAGE FORMING APPARATUS

CROSS-REFERENCE TO RELATED APPLICATIONS

This patent application is based on and claims priority pursuant to 35 U.S.C. §119 to Japanese Patent Application Nos. 2015-052248, filed on Mar. 16, 2015, and 2016-010038, filed on Jan. 21, 2016, in the Japanese Patent Office, the entire disclosure of each of which is hereby incorporated by reference herein.

BACKGROUND

Technical Field

Exemplary aspects of the present disclosure relate to a fixing device and an image forming apparatus, and more particularly, to a fixing device for fixing a toner image on a recording medium and an image forming apparatus incorporating the fixing device.

Description of the Background

Related-art image forming apparatuses, such as copiers, facsimile machines, printers, or multifunction printers having two or more of copying, printing, scanning, facsimile, plotter, and other functions, typically form an image on a recording medium according to image data. Thus, for example, a charger uniformly charges a surface of a photoconductor; an optical writer emits a light beam onto the charged surface of the photoconductor to form an electrostatic latent image on the photoconductor according to the image data; a developing device supplies toner to the electrostatic latent image formed on the photoconductor to render the electrostatic latent image visible as a toner image; the toner image is directly transferred from the photoconductor onto a recording medium or is indirectly transferred from the photoconductor onto a recording medium via an intermediate transfer belt; finally, a fixing device applies heat and pressure to the recording medium bearing the toner image to fix the toner image on the recording medium, thus forming the image on the recording medium.

Such fixing device may include a fixing rotator, such as a fixing roller, a fixing belt, and a fixing film, heated by a heater and an opposed rotator, such as a pressure roller and a pressure belt, pressed against the fixing rotator to form a fixing nip therebetween through which a recording medium bearing a toner image is conveyed. As the recording medium bearing the toner image is conveyed through the fixing nip, the fixing rotator and the opposed rotator apply heat and pressure to the recording medium, melting and fixing the toner image on the recording medium.

SUMMARY

This specification describes below an improved fixing device. In one exemplary embodiment, the fixing device includes a flexible fixing rotator rotatable in a predetermined direction of rotation and an opposed rotator disposed opposite the fixing rotator. A nip formation pad presses against the opposed rotator via the fixing rotator to form a fixing nip between the fixing rotator and the opposed rotator, through which a recording medium bearing a toner image is conveyed. The nip formation pad includes a first nip formation portion and a second nip formation portion layered on the first nip formation portion and sandwiched between the first nip formation portion and the fixing rotator. A primary heater is disposed opposite the fixing rotator in a circumferential span other than the fixing nip in the direction of rotation of the fixing rotator and in a primary heating span spanning in an axial direction of the fixing rotator. The primary heater heats the primary heating span of the fixing rotator from which heat is conducted to the nip formation pad with a primary conduction. A secondary heater is disposed opposite the fixing rotator in the fixing nip and in a secondary heating span that is outboard from the primary heating span in the axial direction of the fixing rotator. The secondary heater is interposed between the first nip formation portion and the second nip formation portion to heat the secondary heating span of the fixing rotator through the nip formation pad from which heat is conducted to the fixing rotator with a secondary conduction greater than the primary conduction.

This specification further describes an improved image forming apparatus. In one exemplary embodiment, the image forming apparatus includes an image bearer to bear a toner image and a fixing device disposed downstream from the image bearer in a recording medium conveyance direction to fix the toner image on a recording medium. The fixing device includes a flexible fixing rotator rotatable in a predetermined direction of rotation and an opposed rotator disposed opposite the fixing rotator. A nip formation pad presses against the opposed rotator via the fixing rotator to form a fixing nip between the fixing rotator and the opposed rotator, through which the recording medium bearing the toner image is conveyed. The nip formation pad includes a first nip formation portion and a second nip formation portion layered on the first nip formation portion and sandwiched between the first nip formation portion and the fixing rotator. A primary heater is disposed opposite the fixing rotator in a circumferential span other than the fixing nip in the direction of rotation of the fixing rotator and in a primary heating span spanning in an axial direction of the fixing rotator. The primary heater heats the primary heating span of the fixing rotator from which heat is conducted to the nip formation pad with a primary conduction. A secondary heater is disposed opposite the fixing rotator in the fixing nip and in a secondary heating span that is outboard from the primary heating span in the axial direction of the fixing rotator. The secondary heater is interposed between the first nip formation portion and the second nip formation portion to heat the secondary heating span of the fixing rotator through the nip formation pad from which heat is conducted to the fixing rotator with a secondary conduction greater than the primary conduction.

BRIEF DESCRIPTION OF THE DRAWINGS

A more complete appreciation of the disclosure and the many attendant advantages thereof will be readily obtained as the same becomes better understood by reference to the following detailed description when considered in connection with the accompanying drawings, wherein.

DETAILED DESCRIPTION OF THE DISCLOSURE

Figure 1:
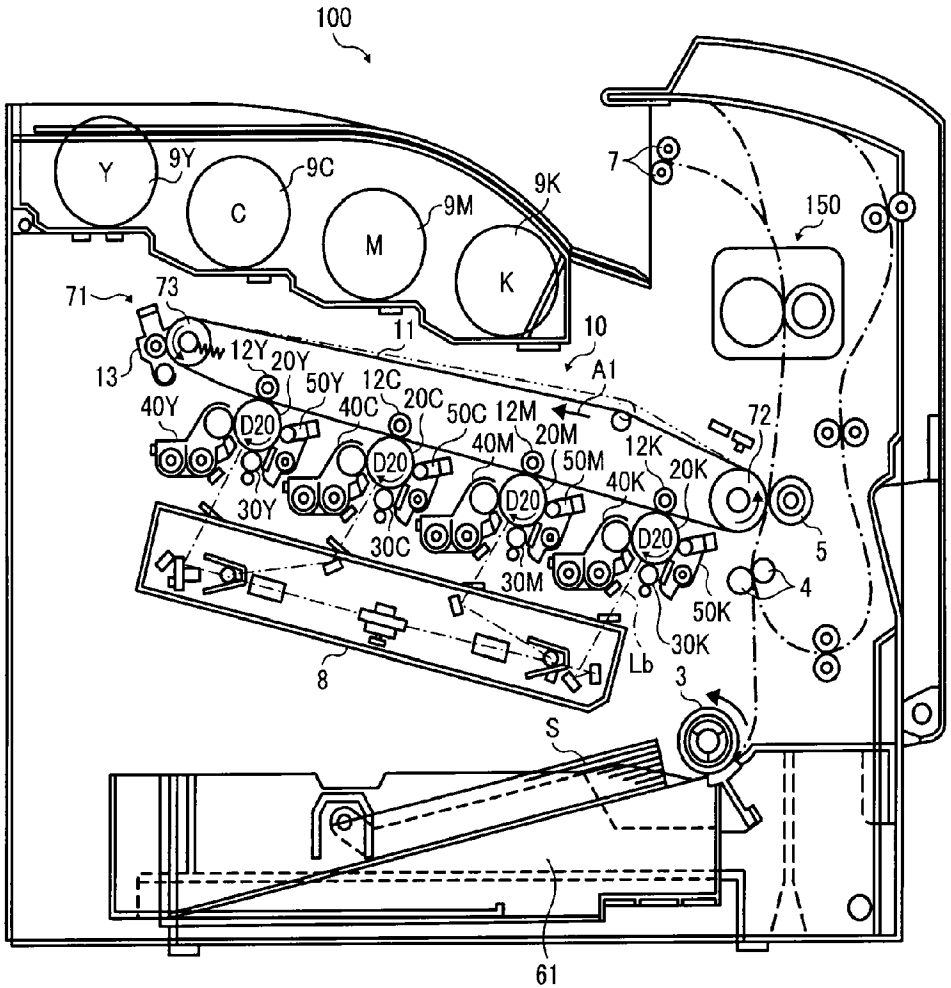
FIG. 1 is a schematic vertical cross-sectional view of an image forming apparatus according to an exemplary embodiment of the present disclosure.

In describing exemplary embodiments illustrated in the drawings, specific terminology is employed for the sake of clarity. However, the disclosure of this specification is not intended to be limited to the specific terminology so selected and it is to be understood that each specific element includes all technical equivalents that operate in a similar manner and achieve a similar result.

Referring now to the drawings, wherein like reference numerals designate identical or corresponding parts throughout the several views, in particular to FIG. 1, an image forming apparatus 100 according to an exemplary embodiment of the present disclosure is explained.

It is to be noted that, in the drawings for explaining exemplary embodiments of this disclosure, identical reference numerals are assigned, as long as discrimination is possible, to components such as members and component parts having an identical function or shape, thus omitting description thereof once it is provided.

FIG. 1 is a schematic vertical cross-sectional view of the image forming apparatus 100. The image forming apparatus 100 may be a copier, a facsimile machine, a printer, a multifunction peripheral or a multifunction printer (MFP) having at least one of copying, printing, scanning, facsimile, and plotter functions, or the like. According to this exemplary embodiment, the image forming apparatus 100 is a color printer that forms color and monochrome toner images on a recording medium by electrophotography. Alternatively, the image forming apparatus 100 may be a monochrome printer that forms a monochrome toner image on a recording medium.

A description is provided of a construction and an operation of the image forming apparatus 100.

The image forming apparatus 100 is a color printer employing a tandem system in which a plurality of image forming devices for forming toner images in a plurality of colors, respectively, is aligned in a rotation direction of an intermediate transfer belt.

The image forming apparatus 100 includes four photoconductive drums 20Y, 20C, 20M, and 20K serving as image bearers that bear yellow, cyan, magenta, and black toner images in separation colors, respectively, that is, yellow, cyan, magenta, and black.

The yellow, cyan, magenta, and black toner images formed on the photoconductive drums 20Y, 20C, 20M, and 20K as visible images, respectively, are primarily transferred successively onto an intermediate transfer belt 11 serving as an intermediate transferer disposed opposite the photoconductive drums 20Y, 20C, 20M, and 20K as the intermediate transfer belt 11 rotates in a rotation direction A1 such that the yellow, cyan, magenta, and black toner images are superimposed on a same position on the intermediate transfer belt 11 in a primary transfer process. Thereafter, the yellow, cyan, magenta, and black toner images superimposed on the intermediate transfer belt 11 are secondarily transferred onto a sheet S serving as a recording medium collectively in a secondary transfer process. Each of the photoconductive drums 20Y, 20C, 20M, and 20K is surrounded by image forming components that form the yellow, cyan, magenta, and black toner images on the photoconductive drums 20Y, 20C, 20M, and 20K as the photoconductive drums 20Y, 20C, 20M, and 20K rotate clockwise in FIG. 1 in a rotation direction D20.

Taking the photoconductive drum 20K that forms the black toner image, the following describes a construction of components that form the black toner image. The photoconductive drum 20K is surrounded by a charger 30K, a developing device 40K, a primary transfer roller 12K, and a cleaner 50K in this order in the rotation direction D20 of the photoconductive drum 20K. The photoconductive drums 20Y, 20C, and 20M are also surrounded by chargers 30Y, 30C, and 30M, developing devices 40Y, 40C, and 40M, primary transfer rollers 12Y, 12C, and 12M, and cleaners 50Y, 50C, and 50M in this order in the rotation direction D20 of the photoconductive drums 20Y, 20C, and 20M, respectively. The charger 30K uniformly changes an outer circumferential surface of the photoconductive drum 20K. An optical writing device 8 optically writes an electrostatic latent image on the charged outer circumferential surface of the photoconductive drum 20K according to image data sent from an external device such as a client computer. The developing device 40K visualizes the electrostatic latent image as a black toner image.

As the intermediate transfer belt 11 rotates in the rotation direction A1, the yellow, cyan, magenta, and black toner images formed on the photoconductive drums 20Y, 20C, 20M, and 20K, respectively, are primarily transferred successively onto the intermediate transfer belt 11, thus being superimposed on the same position on the intermediate transfer belt 11 and formed into a color toner image. In the primary transfer process, the primary transfer rollers 12Y, 12C, 12M, and 12K disposed opposite the photoconductive drums 20Y, 20C, 20M, and 20K via the intermediate transfer belt 11, respectively, apply a primary transfer bias to the photoconductive drums 20Y, 20C, 20M, and 20K successively from the upstream photoconductive drum 20Y to the downstream photoconductive drum 20K in the rotation direction A1 of the intermediate transfer belt 11. The photoconductive drums 20Y, 20C, 20M, and 20K are aligned in this order in the rotation direction A1 of the intermediate transfer belt 11. The photoconductive drums 20Y, 20C, 20M, and 20K are located in four image forming stations that form the yellow, cyan, magenta, and black toner images, respectively.

The image forming apparatus 100 includes the four image forming stations that form the yellow, cyan, magenta, and black toner images, respectively, an intermediate transfer belt unit 10, a secondary transfer roller 5, an intermediate transfer belt cleaner 13, and the optical writing device 8. The intermediate transfer belt unit 10 is situated above and disposed opposite the photoconductive drums 20Y, 20C, 20M, and 20K. The intermediate transfer belt unit 10 incorporates the intermediate transfer belt 11 and the primary transfer rollers 12Y, 12C, 12M, and 12K. The secondary transfer roller 5 serves as a secondary transferer disposed opposite the intermediate transfer belt 11 and driven and rotated in accordance with rotation of the intermediate transfer belt 11. The intermediate transfer belt cleaner 13 is disposed opposite the intermediate transfer belt 11 to clean the intermediate transfer belt 11. The optical writing device 8 is situated below and disposed opposite the four image forming stations.

The optical writing device 8 includes a semiconductor laser serving as a light source, a coupling lens, an fθ lens, a troidal lens, a deflection mirror, and a rotatable polygon mirror serving as a deflector. The optical writing device 8 emits light beams Lb corresponding to the yellow, cyan, magenta, and black toner images to be formed on the photoconductive drums 20Y, 20C, 20M, and 20K thereto, forming electrostatic latent images on the photoconductive drums 20Y, 20C, 20M, and 20K, respectively. FIG. 1 illustrates the light beam Lb irradiating the photoconductive drum 20K. Similarly, light beams irradiate the photoconductive drums 20Y, 20C, and 20M, respectively.

The image forming apparatus 100 further includes a sheet feeder 61 and a registration roller pair 4. The sheet feeder 61, disposed in a lower portion of the image forming apparatus 100, incorporates a paper tray that loads a plurality of sheets S to be conveyed to a secondary transfer nip formed between the intermediate transfer belt 11 and the secondary transfer roller 5. The registration roller pair 4 serving as a conveyor conveys the sheet S conveyed from the sheet feeder 61 to the secondary transfer nip formed between the intermediate transfer belt 11 and the secondary transfer roller 5 at a predetermined time when the yellow, cyan, magenta, and black toner images superimposed on the intermediate transfer belt 11 reach the secondary transfer nip. The image forming apparatus 100 further includes a sensor for detecting that a leading edge of the sheet S reaches the registration roller pair 4.

The secondary transfer roller 5 secondarily transfers the color toner image formed on the intermediate transfer belt 11 onto the sheet S as the sheet S is conveyed through the secondary transfer nip. The sheet S bearing the color toner image is conveyed to a fixing device 150 where the color toner image is fixed on the sheet S under heat and pressure. An output roller pair 7 ejects the sheet S bearing the fixed color toner image onto an output tray disposed atop the image forming apparatus 100. In an upper portion of the image forming apparatus 100 and below the output tray are toner bottles 9Y, 9C, 9M, and 9K containing fresh yellow, cyan, magenta, and black toners, respectively.

The intermediate transfer belt unit 10 includes a driving roller 72 and a driven roller 73 over which the intermediate transfer belt 11 is looped, in addition to the intermediate transfer belt 11 and the primary transfer rollers 12Y, 12C, 12M, and 12K. Since the driven roller 73 also serves as a tension applicator that applies tension to the intermediate transfer belt 11, a biasing member (e.g., a spring) biases the driven roller 73 against the intermediate transfer belt 11. The intermediate transfer belt unit 10 incorporating the intermediate transfer belt 11 and the primary transfer rollers 12Y, 12C, 12M, and 12K, the secondary transfer roller 5, and the intermediate transfer belt cleaner 13 constitute a transfer device 71. The sheet feeder 61 includes a feed roller 3 that contacts an upper side of an uppermost sheet S of the plurality of sheets S loaded on the paper tray of the sheet feeder 61. As the feed roller 3 is driven and rotated counterclockwise in FIG. 1, the feed roller 3 feeds the uppermost sheet S to the registration roller pair 4.

The intermediate transfer belt cleaner 13 of the transfer device 71 includes a cleaning brush and a cleaning blade disposed opposite and contacting the intermediate transfer belt 11. The cleaning brush and the cleaning blade scrape a foreign substance such as residual toner particles off the intermediate transfer belt 11, removing the foreign substance from the intermediate transfer belt 11 and thereby cleaning the intermediate transfer belt 11. The intermediate transfer belt cleaner 13 further includes a waste toner conveyer that conveys the residual toner particles removed from the intermediate transfer belt 11.

Figure 2:
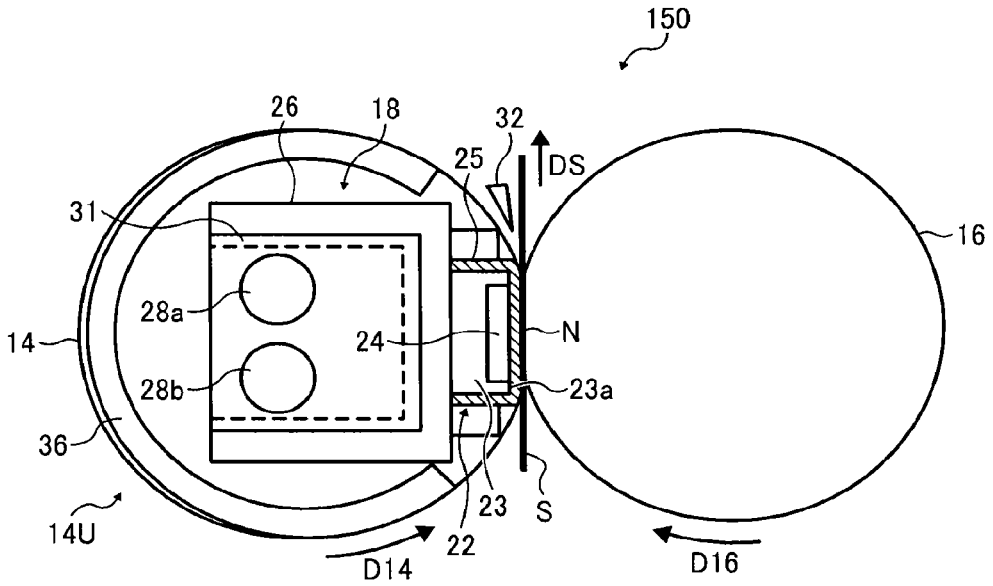
FIG. 2 is a schematic vertical cross-sectional view of a fixing device according to a first exemplary embodiment of the present disclosure, which is incorporated in the image forming apparatus illustrated in FIG. 1.

Referring to FIG. 2, a description is provided of a configuration of the fixing device 150 incorporated in the image forming apparatus 100 having the construction described above.

FIG. 2 is a schematic vertical cross-sectional view of the fixing device 150. As illustrated in FIG. 2, the fixing device 150 (e.g., a fuser or a fusing unit) includes a thin, flexible, endless fixing belt 14, serving as an endless belt, a fixing rotator, or a fixing member, formed into a loop and rotatable in a rotation direction D14 and a pressure roller 16 serving as an opposed rotator disposed outside the loop formed by the fixing belt 14 and disposed opposite the fixing belt 14. The pressure roller 16 is rotatable in a rotation direction D16. The fixing belt 14 is tubular or cylindrical. Inside the loop formed by the fixing belt 14 is a nip formation assembly 18 (e.g., a nip formation unit) that forms a fixing nip N between the fixing belt 14 and the pressure roller 16, through which the sheet S is conveyed.

A detailed description is now given of a construction of the nip formation assembly 18.

The nip formation assembly 18 includes a nip formation pad 22 and a stay 26. The nip formation pad 22, disposed inside the loop formed by the fixing belt 14 and disposed opposite the pressure roller 16, presses against the pressure roller 16 via the fixing belt 14 to form the fixing nip N between the fixing belt 14 and the pressure roller 16. The stay 26 supports the nip formation pad 22 against pressure from the pressure roller 16.

The nip formation pad 22 includes a base 23 serving as a first nip formation portion and a thermal equalizer 25 serving as a second nip formation portion mounted on a fixing nip side face 23*a* of the base 23. The thermal equalizer 25 is layered on the base 23 at the fixing nip N in a thickness direction of the fixing belt 14. A laminated heater 24 serving as a secondary heater is sandwiched between the base 23 and the thermal equalizer 25. Each of the base 23, the thermal equalizer 25, and the stay 26 has a width not smaller than a width of the fixing belt 14 in an axial direction thereof parallel to a longitudinal direction of the base 23, the thermal equalizer 25, and the stay 26.

The thermal equalizer 25 prevents heat generated by the laminated heater 24 from being stored locally and facilitates conduction of heat in the longitudinal direction of the thermal equalizer 25 parallel to the axial direction of the fixing belt 14, thus reducing uneven temperature of the fixing belt 14 in the axial direction thereof. Hence, the thermal equalizer 25 is made of a material that conducts heat quickly, for example, a material having an increased thermal conductivity such as copper, aluminum, and silver. It is preferable that the thermal equalizer 25 is made of copper in a comprehensive view of manufacturing costs, availability, thermal conductivity, and processing. According to this exemplary embodiment, a copper plate having a thickness of about 0.5 mm is folded into a recess of the thermal equalizer 25. FIG. 2 illustrates the thickness of the thermal equalizer 25 exaggeratingly.

An inner circumferential surface of the fixing belt 14 slides over the thermal equalizer 25 via a low-friction sheet serving as a slide sheet. The slide sheet is applied with a lubricant such as fluorine grease and silicone oil to decrease a slide torque of the fixing belt 14. Alternatively, the thermal equalizer 25 may contact the inner circumferential surface of the fixing belt 14 directly. The fixing device 150 further includes two halogen heaters 28*a* and 28*b* and a reflector 31 disposed inside the loop formed by the fixing belt 14.

A detailed description is now given of a configuration of the halogen heaters 28*a* and 28*b*.

The stay 26 has a box shape with an opening opposite the fixing nip N. The two halogen heaters 28*a* and 28*b* serving as a primary heater are disposed inside the box of the stay 26. The halogen heaters 28*a* and 28*b* emit light that irradiates the inner circumferential surface of the fixing belt 14 directly through the opening of the stay 26 opposite the fixing nip N, heating the fixing belt 14 with radiation heat directly.

A detailed description is now given of a configuration of the reflector 31.

The platy reflector 31 is mounted on an interior surface of the stay 26 to reflect light radiated from the halogen heaters 28*a* and 28*b* toward the fixing belt 14 so as to improve heating efficiency of the halogen heaters 28*a* and 28*b* to heat the fixing belt 14. The reflector 31 prevents light radiated from the halogen heaters 28*a* and 28*b* from heating the stay 26, suppressing waste of energy. Alternatively, instead of the reflector 31, the interior surface of the stay 26 may be treated with insulation or mirror finish to reflect light radiated from the halogen heaters 28*a* and 28*b* toward the fixing belt 14.

A detailed description is now given of a construction of the pressure roller 16.

Figure 3:
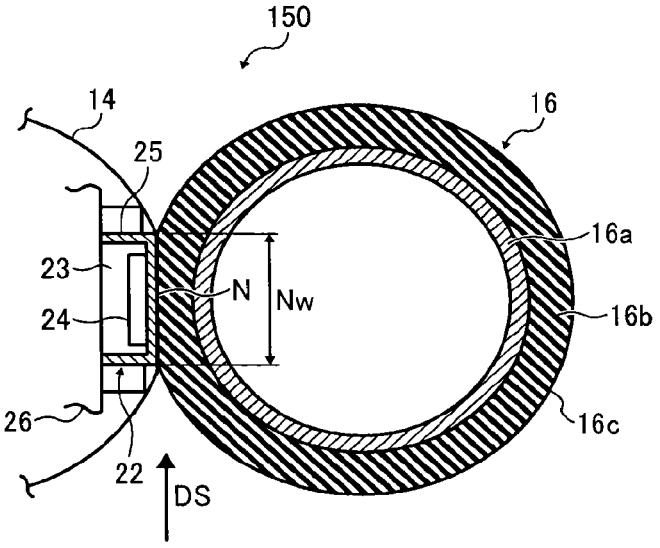
FIG. 3 is a partial vertical cross-sectional view of the fixing device illustrated in FIG. 2.

FIG. 3 is a partial vertical cross-sectional view of the fixing device 150. As illustrated in FIG. 3, the pressure roller 16 is constructed of a hollow metal roller 16*a*, an elastic layer 16*b* coating an outer circumferential surface of the metal roller 16*a* and being made of silicone rubber, and a release layer 16*c* coating an outer circumferential surface of the elastic layer 16*b*. The release layer 16*c*, having a layer thickness in a range of from 5 micrometers to 50 micrometers, is made of perfluoroalkoxy fluoro resin (PFA) or polytetrafluoroethylene (PTFE) to facilitate separation of the sheet S from the pressure roller 16. As a driving force generated by a driver (e.g., a motor) situated inside the image forming apparatus 100 depicted in FIG. 1 is transmitted to the pressure roller 16 through a gear train, the pressure roller 16 rotates in the rotation direction D16 as illustrated in FIG. 2. Alternatively, the driver may also be connected to the fixing belt 14 to drive and rotate the fixing belt 14. A spring or the like biases the pressure roller 16 against the fixing belt 14. As the elastic layer 16*b* of the pressure roller 16 is pressed and deformed, the pressure roller 16 produces the fixing nip N defined by a circumferential fixing nip span having a predetermined length Nw in a sheet conveyance direction DS as illustrated in FIG. 3.

Alternatively, the pressure roller 16 may be a solid roller. However, a hollow roller has a decreased thermal capacity. Further, a heater or a heat source such as a halogen heater may be disposed inside the pressure roller 16. The elastic layer 16*b* may be made of solid rubber. Alternatively, if no heater is situated inside the pressure roller 16, the elastic layer 16*b* may be made of sponge rubber. The sponge rubber is more preferable than the solid rubber because the sponge rubber has an increased insulation that draws less heat from the fixing belt 14.

A detailed description is now given of a construction of the fixing belt 14.

The fixing belt 14 is an endless belt or film having a layer thickness in a range of from 30 micrometers to 50 micrometers and made of metal such as nickel and SUS stainless steel or resin such as polyimide. The fixing belt 14 is constructed of a base layer and a release layer. The release layer constituting an outer surface layer is made of PFA, PTFE, or the like to facilitate separation of toner of a toner image on the sheet S from the fixing belt 14, thus preventing the toner of the toner image from adhering to the fixing belt 14. Optionally, an elastic layer, made of silicone rubber or the like, may be sandwiched between the base layer and the release layer. If the fixing belt 14 does not incorporate the elastic layer, the fixing belt 14 has a decreased thermal capacity that improves fixing property of being heated quickly to a desired fixing temperature at which the toner image is fixed on the sheet S. However, as the pressure roller 16 and the fixing belt 14 sandwich and press the unfixed toner image on the sheet S passing through the fixing nip N, slight surface asperities of the fixing belt 14 may be transferred onto the toner image on the sheet S, resulting in variation in gloss of the solid toner image on the sheet S.

To address this circumstance, the elastic layer made of silicone rubber has a thickness not smaller than 100 micrometers. As the elastic layer deforms, the elastic layer absorbs slight surface asperities of the sheet S, suppressing variation in gloss of the toner image on the sheet S. As illustrated in FIG. 2, as the pressure roller 16 rotates in the rotation direction D16, the fixing belt 14 rotates in the rotation direction D14 in accordance with rotation of the pressure roller 16 by friction therebetween. At the fixing nip N, the fixing belt 14 rotates as the fixing belt 14 is sandwiched between the pressure roller 16 and the nip formation pad 22; at a circumferential span of the fixing belt 14 other than the fixing nip N, the fixing belt 14 rotates while the fixing belt 14 is supported at each lateral end in the axial direction thereof to retain a tubular shape. Thus, the fixing belt 14 is retained circular in cross-section stably. As illustrated in FIG. 2, a separator 32 is disposed downstream from the fixing nip N in the sheet conveyance direction DS to separate the sheet S from the fixing belt 14.

According to this exemplary embodiment, as illustrated in FIGS. 2 and 3, the fixing nip N is planar. Alternatively, the fixing nip N may define a curve projecting toward the fixing belt 14 to contour the fixing belt 14 into a recess in cross-section at the fixing nip N or other shapes. If the fixing nip N defines the recess in the fixing belt 14, the recessed fixing nip N directs the leading edge of the sheet S toward the pressure roller 16 as the sheet S is ejected from the fixing nip N, facilitating separation of the sheet S from the fixing belt 14 and suppressing jamming of the sheet S. Conversely, if the fixing nip N is planar, an envelope serving as a recording medium is conveyed through the fixing nip N smoothly. In order to define the recessed fixing nip N, the fixing nip side face 23*a* of the base 23 that is disposed opposite the pressure roller 16 is contoured into a recess in cross-section. Similarly, the thermal equalizer 25 may be contoured along the fixing nip side face 23*a* of the base 23 in cross-section.

A detailed description is now given of a configuration of the stay 26.

The stay 26 supports the nip formation pad 22 against pressure from the pressure roller 16 to prevent bending of the nip formation pad 22 and produce the even length Nw of the fixing nip N in the sheet conveyance direction DS throughout the entire width of the fixing belt 14 in the axial direction thereof. According to this exemplary embodiment, the pressure roller 16 is pressed against the fixing belt 14 to form the fixing nip N. Alternatively, the nip formation assembly 18 may be pressed against the pressure roller 16 to from the fixing nip N. The stay 26 has a mechanical strength great enough to support the nip formation pad 22 so as to prevent bending of the nip formation pad 22. The stay 26 is made of metal such as stainless steel and iron or metallic oxide such as ceramics. The fixing belt 14 and the components disposed inside the loop formed by the fixing belt 14, that is, the halogen heaters 28*a* and 28*b*, the nip formation pad 22, the laminated heater 24, the stay 26, and the reflector 31, may constitute a belt unit 14U separably coupled with the pressure roller 16.

Figure 4:
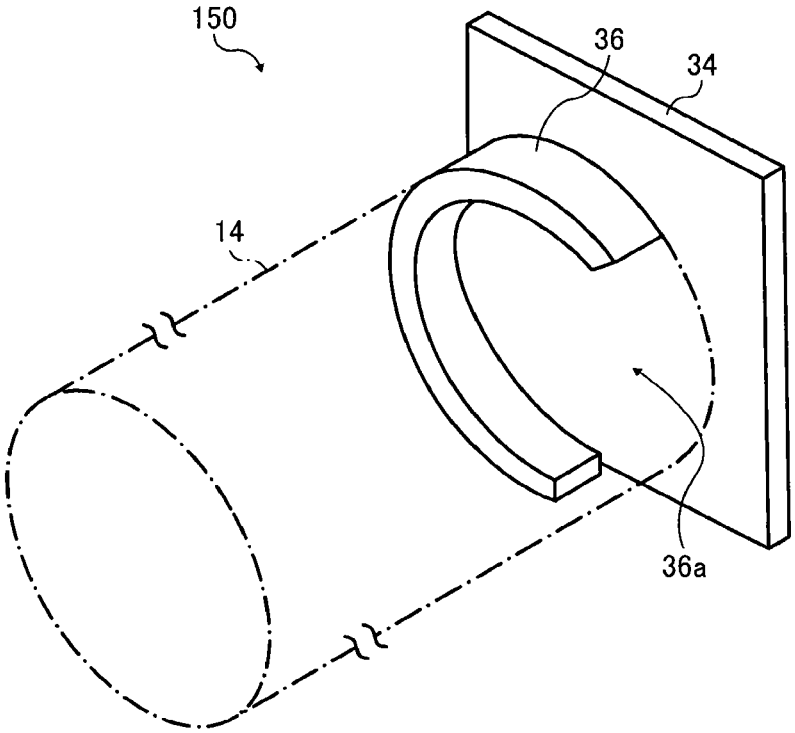
FIG. 4 is a partial perspective view of the fixing device illustrated in FIG. 3.

FIG. 4 is a partial perspective view of the fixing device 150. As illustrated in FIG. 4, both lateral ends of the fixing belt 14 in the axial direction thereof are rotatably supported by flanges 36, respectively. Each of the flanges 36 serves as a support projecting from a side plate 34 in the axial direction of the fixing belt 14. Although FIG. 4 illustrates the flange 36 and the side plate 34 situated at one lateral end of the fixing belt 14 in the axial direction thereof, the flange 36 and the side plate 34 are also situated at another lateral end of the fixing belt 14 in the axial direction thereof. The flange 36 that guides each lateral end of the fixing belt 14 in the axial direction thereof has an outer diameter substantially equivalent to an inner diameter of the fixing belt 14. The flange 36 projects inboard from each lateral edge of the fixing belt 14 by a length in a range of from 5 mm to 10 mm in the axial direction of the fixing belt 14. The flanges 36 guide the fixing belt 14 even when the fixing belt 14 rotates, retaining the fixing belt 14 to be circular in cross-section.

The flange 36 includes a slit 36*a* disposed opposite the fixing nip N to place the nip formation assembly 18 at a predetermined position. The stay 26 depicted in FIG. 2 has a width that spans the entire width of the fixing belt 14 in the axial direction thereof. Both lateral ends of the stay 26 in the axial direction of the fixing belt 14 are fixedly secured on the side plates 34, respectively, thus being supported and positioned by the side plates 34.

Figure 5:
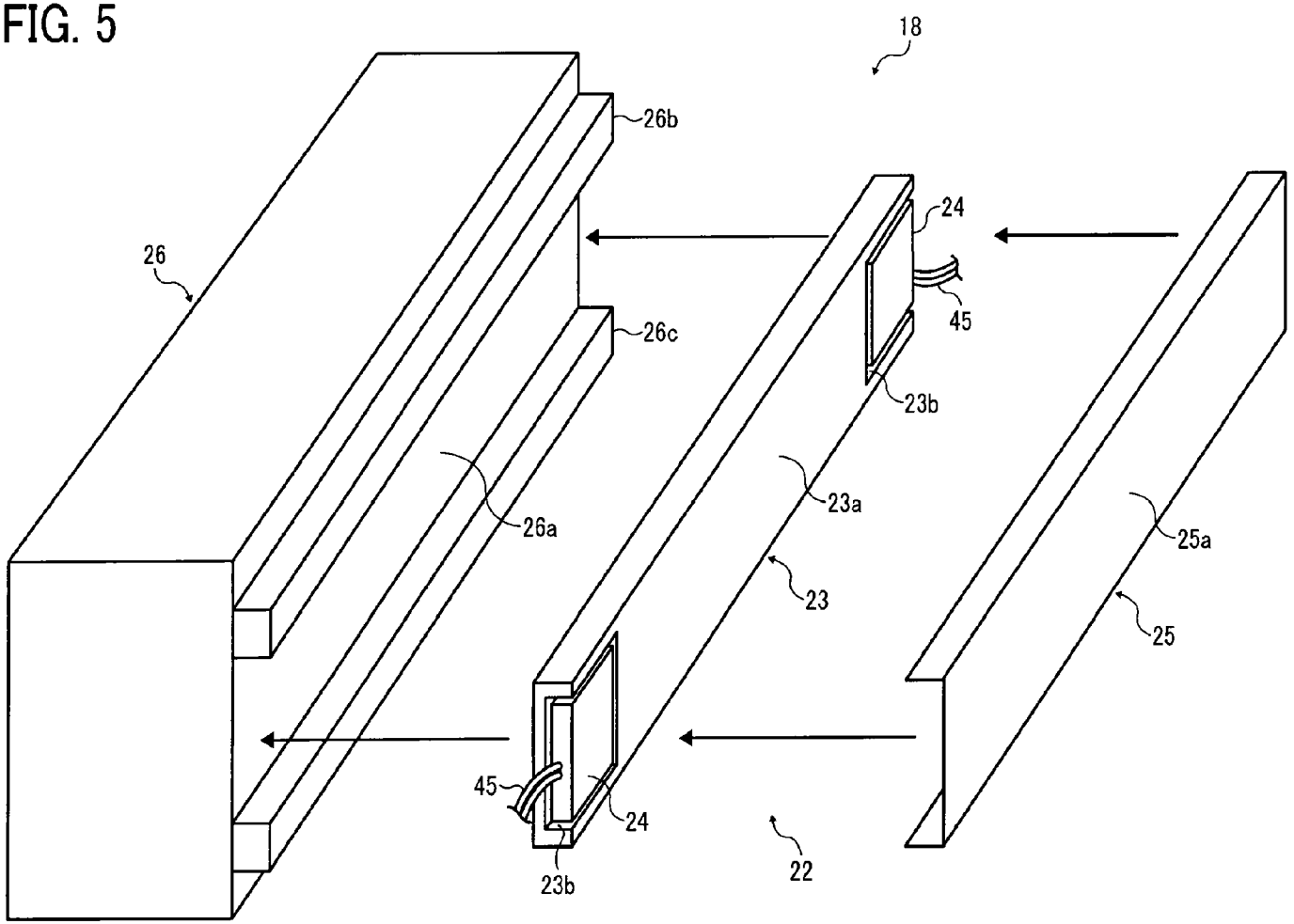
FIG. 5 is an exploded perspective view of a nip formation assembly incorporated in the fixing device illustrated in FIG. 2.

FIG. 5 is an exploded perspective view of the nip formation assembly 18. As illustrated in FIG. 5, a side face 26*a* of the stay 26 that faces the pressure roller 16 mounts two ridges 26*b* and 26*c* extending in the axial direction of the fixing belt 14. The fixing nip side face 23*a* of the base 23 that is disposed opposite the pressure roller 16 mounts two recesses 23*b* at both lateral ends of the base 23 in the longitudinal direction thereof, respectively. Each of the recesses 23*b* accommodates the laminated heater 24. The laminated heaters 24 are attached to or secured to the recesses 23*b* with an adhesive or the like, respectively. The thermal equalizer 25 engages or is attached to the base 23 with an adhesive or the like such that the thermal equalizer 25 covers the fixing nip side face 23*a* of the base 23 and the laminated heaters 24 coupled with the base 23. The base 23 and the thermal equalizer 25 coupled with the base 23 are sandwiched between the ridges 26*b* and 26*c* and positioned on the stay 26. The base 23 and the thermal equalizer 25 are secured to the side face 26*a* of the stay 26 with an adhesive or the like. Thus, a fixing nip side face 25*a* of the thermal equalizer 25 serves as a nip formation face that defines the fixing nip N.

The thermal equalizer 25 supported by the base 23 includes the fixing nip side face 25*a* disposed opposite the pressure roller 16 via the fixing belt 14 and in direct contact with the inner circumferential surface of the fixing belt 14. Thus, the fixing nip side face 25*a* of the thermal equalizer 25 serves as a nip formation face that forms the fixing nip N. Since the thermal equalizer 25 is supported by the base 23 supported by the stay 26, the thermal equalizer 25 attains a rigidity against pressure from the pressure roller 16.

Figure 6:
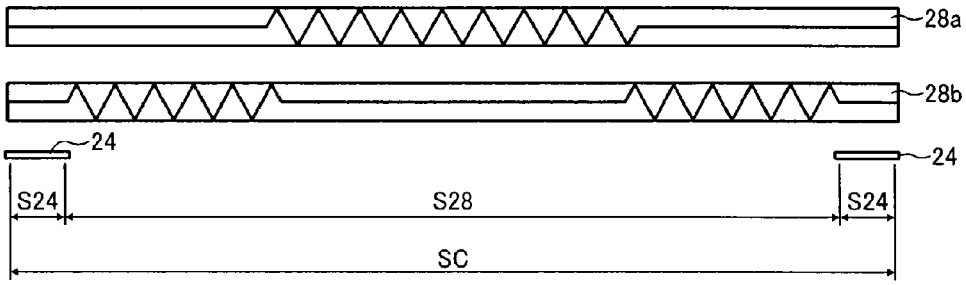
FIG. 6 is a diagram illustrating a relation between a heating span of halogen heaters and a heating span of a laminated heater of the fixing device illustrated in FIG. 2.

FIG. 6 is a diagram illustrating a relation between a heating span of the halogen heaters 28*a* and 28*b* and a heating span of the laminated heater 24. As illustrated in FIG. 6, the halogen heaters 28*a* and 28*b* heat the fixing belt 14 in a primary heating span S28 in the axial direction of the fixing belt 14. The primary heating span S28 is equivalent to a width of an A3 size sheet in portrait orientation and an A4 size sheet in landscape orientation in the axial direction of the fixing belt 14. Each of the laminated heaters 24 heats the fixing belt 14 in a secondary heating span S24 in the axial direction of the fixing belt 14. The primary heating span S28 and the secondary heating spans S24 constitute a combined heating span SC that is equivalent to a width of an A3 extension size sheet and a 13-inch sheet in the axial direction of the fixing belt 14. Each of the laminated heaters 24 is disposed outboard from the primary heating span S28 of the halogen heaters 28*a* and 28*b* in the axial direction of the fixing belt 14.

The image forming apparatus 100 is requested to perform image formation on sheets of various sizes and types. Accordingly, the fixing device 150 is requested to convey sheets of various widths and thicknesses. For example, the fixing device 150 is requested to convey a small sheet, a medium sheet, and a large sheet. The small sheet has a width of about 100 mm in the axial direction of the fixing belt 14 and includes a postcard and an envelope. The medium sheet has a width of about 300 mm in the axial direction of the fixing belt 14 and includes the A3 size sheet in portrait orientation and the A4 size sheet in landscape orientation that are used frequently. The large sheet is slightly greater than the A3 size sheet and includes the A3 extension size sheet and the 13-inch sheet.

The width of the A3 size sheet in portrait orientation and the width of the A4 size sheet in landscape orientation are smaller than the width of the A3 extension size sheet in portrait orientation (e.g., 329 mm) and the width of the 13-inch sheet in portrait orientation (e.g., 330 mm) by a differential in a range of from 32 mm to 33 mm. Accordingly, if the fixing device 150 is configured to heat each lateral end span of the fixing belt 14 in the axial direction thereof, that is, if the laminated heater 24 is configured to heat a half of the differential in the range of from 32 mm to 33 mm, that is, a span in a range of from 16.0 mm to 16.5 mm, a maximum sheet available in the fixing device 150 increases from the A3 size sheet to the 13-inch sheet or the like as illustrated in FIG. 6. The laminated heater 24 is a downsized heater having a decreased width of about 20 mm in the axial direction of the fixing belt 14.

As the large sheet (e.g., the A3 extension size sheet and the 13-inch sheet) is conveyed through the fixing nip N, the halogen heaters 28*a* and 28*b* and the laminated heaters 24 are energized. Conversely, as the medium sheet or the small sheet that are not greater than the A3 size sheet are conveyed through the fixing nip N, the halogen heaters 28*a* and 28*b* are energized or the halogen heater 28*a* is energized. Hence, the laminated heaters 24 are not energized.

A description is provided of a configuration of a comparative fixing device.

The image forming apparatus 100 is requested to perform image formation on sheets of various sizes. To address this request, the comparative fixing device may include a plurality of halogen heaters having different heating spans, respectively, to heat a fixing rotator (e.g., the fixing belt 14). Energization of the halogen heaters is controlled to switch between the different heating spans at reduced costs. On the other hand, the comparative fixing device is requested to perform fixing on large sheets greater than the A3 size sheet such as the A3 extension size sheet and the 13-inch sheet although the large sheets are used infrequently.

Additionally, the comparative fixing device is requested to save energy. To address this request, a preheating mode of the halogen heaters in which the halogen heaters are ready to heat the fixing rotator quickly to a predetermined fixing temperature at which a toner image is fixed on a sheet is barely available to reduce power consumption. Accordingly, a user may wait for an increased resuming time before fixing resumes from an energy saver mode, degrading convenience of the user. In order to shorten the resuming time, a thin fixing rotator having a decreased thermal capacity may be employed.

For example, the comparative fixing device may include a thin, flexible endless belt to be heated quickly to the fixing temperature and a nip formation pad located inside a loop formed by the endless belt. The nip formation pad presses against a pressure roller via the endless belt to form a fixing nip between the endless belt and the pressure roller. A plurality of halogen heaters having different light distributions, respectively, is situated inside the loop formed by the endless belt and disposed opposite a circumferential span of the endless belt other than the fixing nip. A plurality of lateral end heaters (e.g., laminated heaters) is disposed opposite both lateral end spans of the endless belt in an axial direction thereof, respectively, and upstream from the fixing nip in a rotation direction of the endless belt so that the lateral end heaters, together with the halogen heaters, heat an increased heating span of the endless belt corresponding to a width of the large sheet in the axial direction of the endless belt. The lateral end heaters contact an inner circumferential surface or an outer circumferential surface of the endless belt. The lateral end heaters, together with the halogen heaters, heat the increased heating span of the endless belt corresponding to the width of the large sheet with a simple construction not incorporating an elongated halogen heater elongated in the axial direction of the endless belt to heat the large sheet.

If the comparative fixing device is configured to selectively energize the halogen heaters and the lateral end heaters, the comparative fixing device performs fixing on sheets of various sizes while downsizing the comparative fixing device and saving energy. However, the thin endless belt achieves a decreased amount of heat conducted in the axial direction of the endless belt per unit time. For example, while a sheet is conveyed over a conveyance span of the endless belt, the sheet does not draw heat from a non-conveyance span of the endless belt where the sheet is not conveyed over the endless belt. Accordingly, the non-conveyance span of the endless belt may suffer from overheating. Further, the thin endless belt reduces the amount of heat conducted between the non-conveyance span and the conveyance span, varying the temperature of the endless belt in the axial direction thereof. Consequently, variation in temperature of the endless belt may degrade fixing, resulting in formation of a faulty toner image on the sheet.

In order to allow the comparative fixing device to perform fixing on sheets of various sizes and save energy, the fixing rotator, such as the fixing belt 14, heated by the halogen heaters is requested to be thin. However, the thin fixing rotator may not retain a uniform temperature throughout the entire width of the fixing rotator in an axial direction thereof. Accordingly, the fixing rotator is susceptible to overheating in the non-conveyance span of the fixing rotator where the sheet is not conveyed over the fixing rotator. To address this circumstance, the sheet may be conveyed at a decreased speed and a heater may be supplied with decreased power to prevent overheating of the fixing rotator, degrading satisfaction of the user. In order to allow the comparative fixing device to perform fixing on the large sheet such as the A3 extension size sheet, the plurality of halogen heaters used to heat a small sheet is installed inside the fixing rotator having a diameter of about 30 mm. Accordingly, the number of the halogen heaters is limited.

To address this circumstance, an elongated halogen heater having an elongated heating span corresponding to the width of the large sheet greater than the A3 size sheet may be employed. However, sheets having a width of about 300 mm or smaller are used frequently. Since the elongated heating span of the elongated halogen heater is about 330 mm to heat the large sheet, even when a sheet of a frequently used size having the width of about 300 mm is conveyed through the comparative fixing device, the elongated halogen heater may heat the fixing rotator also in a differential between the elongated heating span of 330 mm and a heating span of about 300 mm corresponding to the width of the sheet of the frequently used size unnecessarily, resulting in waste of energy. When the A3 size sheet in portrait orientation or the A4 size sheet in landscape orientation is conveyed through the comparative fixing device, each lateral end of the fixing rotator in the axial direction thereof that is disposed opposite the elongated heating span of the elongated halogen heater may overheat. In order to cool the overheated lateral end of the fixing rotator, productivity defined by a conveyance speed of the sheet may be degraded or a fan may be installed. If a reflection plate is interposed between the elongated halogen heater and the fixing rotator, each lateral end of the elongated halogen heater in the axial direction of the fixing rotator may overheat.

Alternatively, a cooling fan or the like may cool the fixing rotator directly when the non-conveyance span of the fixing rotator suffers from overheating. However, the cooling fan may not cool the fixing rotator effectively. Yet alternatively, a magnetic shunt alloy that changes magnetism according to the temperature of the fixing rotator may control a magnetic flux to change the elongated heating span of the elongated halogen heater in an induction heating system. However, the magnetic shunt alloy may increase manufacturing costs.

The fixing device 150 according to this exemplary embodiment incorporates a simple mechanism in addition to the halogen heaters 28*a* and 28*b*, that is, the laminated heaters 24 being disposed opposite both lateral end spans of the fixing belt 14 or in proximity to both lateral ends of the fixing belt 14 in the axial direction thereof, respectively, thus addressing the circumstances described above.

With the comparative fixing device described above incorporating the endless belt and the lateral end heaters, if the lateral end heaters press against the endless belt with increased pressure to enhance heat conduction efficiency, the lateral end heaters contact the endless belt with an increased friction therebetween, degrading rotation of the endless belt. Conversely, if the lateral end heaters contact the endless belt with decreased pressure and friction therebetween to improve rotation of the endless belt, the lateral end heaters may contact the endless belt unstably, degrading heat conduction efficiency from the lateral end heaters to the endless belt and therefore degrading heating efficiency. Further, degradation in heat conduction efficiency may overheat the lateral end heaters, resulting in breakage of the endless belt. Additionally, the lateral end heaters may melt residual toner failed to be fixed on the sheet and therefore remaining on the endless belt again on both lateral end spans of the endless belt disposed opposite the lateral end heaters, respectively. Accordingly, the melted toner may adhere to the endless belt.

As illustrated in FIG. 5, according to this exemplary embodiment, the laminated heater 24 is interposed between the base 23 and the thermal equalizer 25 within a span of the fixing nip side face 25*a* serving as the nip formation face. Accordingly, the laminated heater 24 is disposed inside the loop formed by the fixing belt 14 without allocation of an extra space to the laminated heater 24, thus overcoming the disadvantages of the comparative fixing device described above. For example, the laminated heater 24 does not contact the fixing belt 14 directly, eliminating the disadvantage of the comparative fixing device described above caused by the lateral end heaters contacting the endless belt with pressure.

For example, while the laminated heaters 24 that heat the secondary heating spans S24 disposed at both lateral ends of the fixing belt 14 in the axial direction thereof or the vicinity of the both lateral ends of the fixing belt 14, respectively, are energized, actuation of the halogen heaters 28*a* and 28*b* that heat the primary heating span S28 where sheets S smaller than the large sheet are conveyed is controlled in accordance with temperature increase of the secondary heating spans S24 of the fixing belt 14. Accordingly, the fixing device 150 prevents waste of energy caused by the halogen heaters 28*a* and 28*b* that heat the primary heating span S28 of the fixing belt 14 quickly and unnecessarily while the laminated heaters 24 that heat the secondary heating spans S24 generate a decreased amount of heat.

A conveyance speed at which the large sheet heated by the laminated heaters 24 is conveyed is smaller than a conveyance speed at which the sheets S other than the large sheet are conveyed. Thus, the fixing device 150 decreases productivity when the infrequently used, large sheet is conveyed, simplifying the laminated heaters 24 that heat the secondary heating spans S24 of the fixing belt 14, respectively, and reducing manufacturing costs. Consequently, the fixing belt 14 is heated effectively.

As illustrated in FIG. 6, the fixing device 150 includes the two halogen heaters 28*a* and 28*b* serving as a primary heater. Alternatively, the fixing device 150 may include three or more halogen heaters to correspond to various sizes of small sheets.

Figure 7:
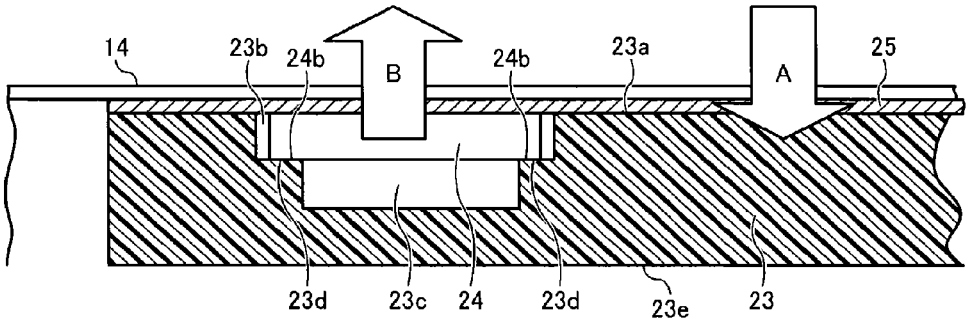
FIG. 7 is a cross-sectional view of the laminated heater, a base, and a thermal equalizer incorporated in the fixing device illustrated in FIG. 2.

Referring to FIG. 7, a description is provided of a configuration of the laminated heaters 24 according to a first exemplary embodiment.

FIG. 7 is a cross-sectional view of the laminated heater 24 disposed opposite one lateral end of the fixing belt 14 in the axial direction thereof, the base 23, and the thermal equalizer 25 seen in the sheet conveyance direction DS depicted in FIG. 2. The fixing belt 14 heated by the halogen heaters 28*a* and 28*b* conducts heat to the sheet S and the toner image on the sheet S while the sheet S is conveyed through the fixing nip N. Simultaneously, heat is conducted from the fixing belt 14 to the thermal equalizer 25 in a direction A and drawn by the thermal equalizer 25. When the fixing belt 14 is heated from an ambient temperature (e.g., a room temperature), the cool thermal equalizer 25 draws an increased amount of heat from the fixing belt 14, increasing a heating time (e.g., a resuming time) taken to heat the fixing belt 14 to the predetermined fixing temperature. To address this circumstance, the fixing belt 14 may be insulated from the thermal equalizer 25 to shorten the heating time.

Conversely, the laminated heater 24 is configured to heat the fixing belt 14 at the fixing nip N. Accordingly, heat generated by the laminated heater 24 is conducted to the thermal equalizer 25 in a direction B with an increased thermal conductivity so that the thermal equalizer 25 conducts heat to the fixing belt 14 quickly, thus shortening the heating time.

Additionally, the thermal equalizer 25 having an increased thermal conductivity attains an even temperature distribution in a plane direction of the fixing nip N. Accordingly, although the laminated heater 24 heats the fixing belt 14 locally, heat generated from the laminated heater 24 does not vary the temperature of the fixing belt 14 in the axial direction thereof, suppressing formation of a faulty toner image that may be caused by variation in temperature of the outer circumferential surface of the fixing belt 14.

The thermal conductivity of the halogen heaters 28*a* and 28*b* serving as a primary heater to conduct heat to the primary heating span S28 of the fixing belt 14 and the thermal conductivity of the laminated heaters 24 serving as a secondary heater to conduct heat to the secondary heating span S24 of the fixing belt 14 are adjusted to shorten the heating time taken to heat the fixing belt 14 to the predetermined fixing temperature, save energy, and prevent formation of a faulty toner image. For example, according to this exemplary embodiment, a primary conduction with which heat is conducted from the fixing belt 14 to the nip formation pad 22 in the primary heating span S28 of the fixing belt 14 disposed opposite and heated by the halogen heaters 28*a* and 28*b* is smaller than a secondary conduction with which heat is conducted from the nip formation pad 22 to the fixing belt 14 in the secondary heating span S24 of the fixing belt 14 disposed opposite and heated by the laminated heater 24.

A description is provided of a configuration of the base 23 serving as a first nip formation portion and the thermal equalizer 25 serving as a second nip formation portion in view of heat conduction.

As illustrated in FIG. 2, as a biasing member (e.g., a spring) presses the pressure roller 16 against the nip formation pad 22 via the fixing belt 14, the base 23 of the nip formation pad 22 receives a load from the pressure roller 16 and transmits the load to the stay 26 that supports the base 23. The base 23 is made of heat resistant resin such as liquid crystal polymer (LCP), polyimide, polyamide imide, polyphenylene sulfide (PPS), and polyethyleneterephthalate (PET). The base 23 is made of resin to draw a decreased amount of heat from the fixing belt 14 and achieve a decreased thermal conductivity and a decreased thermal capacity.

If the base 23 is made of metal or the like that increases the thermal conductivity and the thermal capacity of the base 23, the base 23 may draw heat from the fixing belt 14 excessively, prohibiting the fixing belt 14 from being heated quickly when the fixing device 150 is warmed up from the ambient temperature or when the fixing device 150 resumes fixing from the energy saver mode and therefore resulting in delay in resuming fixing. Since the base 23 does not receive the whole load imposed by the pressure roller 16 and the stay 26 receives the whole load, the base 23 has a mechanical strength great enough to prevent compression and deformation.

Figure 8A:
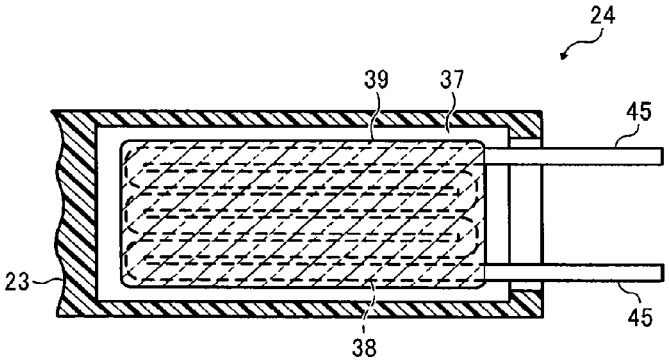
FIG. 8A is a plan view of the laminated heater illustrated in FIG. 7.
Figure 8B:
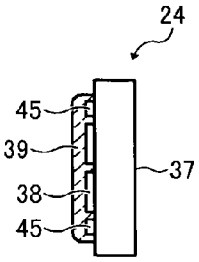
FIG. 8B is a side view of the laminated heater illustrated in FIG. 8A.

FIG. 8A is a plan view of the laminated heater 24. FIG. 8B is a side view of the laminated heater 24. As illustrated in FIG. 8A, the laminated heater 24 includes a ceramic base 37, a resistive heat generator 38 layered on the base 37 with patterning, and an insulative layer 39 layered on the resistive heat generator 38. The ceramic base 37 has an outer size defined by a vertical length of about 10 mm and a horizontal length of about 20 mm in FIG. 8A. The insulative layer 39 is a thin glass layer. Terminals 45, disposed at one lateral end of the laminated heater 24 in the axial direction of the fixing belt 14, are connected to a power supply and a switching element. The resistive heat generator 38 does not extend to an outer marginal portion of the ceramic base 37. Hence, a heat generation amount of an outer marginal portion of the laminated heater 24 is smaller than a heat generation amount of a center portion of the laminated heater 24.

Figure 9A:
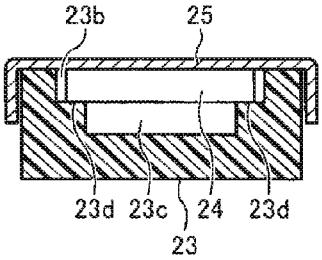
FIG. 9A is a cross-sectional view of the base, the laminated heater, and the thermal equalizer illustrated in FIG. 7 taken along a sheet conveyance direction.
Figure 9B:
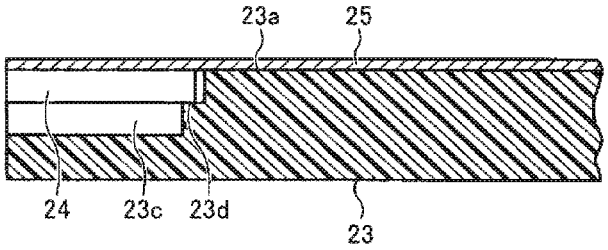
FIG. 9B is a cross-sectional view of the base, the laminated heater, and the thermal equalizer illustrated in FIG. 9A taken along a direction perpendicular to the sheet conveyance direction.

FIG. 9A is a cross-sectional view of the base 23, the laminated heater 24, and the thermal equalizer 25 taken along the sheet conveyance direction DS. FIG. 9B is a cross-sectional view of the base 23, the laminated heater 24, and the thermal equalizer 25 taken along a direction perpendicular to the sheet conveyance direction DS. As illustrated in FIG. 9A, the base 23 includes a recess 23*b*, a cavity 23*c*, and a heater bearing 23*d*. The recess 23*b* accommodates and supports the laminated heater 24. The cavity 23*c* adjoins a bottom face of the recess 23*b*. The heater bearing 23*d* defines an upper face of the cavity 23*c* and has a length in a range of from about 1 mm to about 2 mm. As illustrated in FIG. 7, the heater bearing 23*d* contacts and supports an outer marginal portion 24*b* of the laminated heater 24 that generates a decreased amount of heat.

FIG. 7 illustrates one example of the recess 23*b* that is not open at each lateral end of the recess 23*b* in the axial direction of the fixing belt 14 and is closed on four sides.

With the base 23 constructed of the recess 23*b*, the cavity 23*c*, and the heater bearing 23*d* to support the laminated heater 24, a contact area where the laminated heater 24 contacts the thermal equalizer 25 is greater than a contact area where the laminated heater 24 contacts the base 23 to facilitate conduction of heat from the laminated heater 24 to the thermal equalizer 25 contacting the fixing belt 14. In other words, the base 23 suppresses conduction of heat from the laminated heater 24 to the base 23. The thermal equalizer 25 may contact the ceramic base 37 or the insulative layer 39 of the laminated heater 24. If the thermal equalizer 25 contacts the insulative layer 39 constituting the thin glass layer, heat is conducted from the laminated heater 24 to the thermal equalizer 25 quickly, thus heating the fixing belt 14 effectively.

As described above with reference to FIG. 8A, the resistive heat generator 38 is mounted on a first face of the laminated heater 24 so that the first face of the laminated heater 24 that mounts the resistive heat generator 38 generates heat mainly while a second face of the laminated heater 24 that does not mount the resistive heat generator 38 barely receives heat from the first face. According to this exemplary embodiment, the first face of the laminated heater 24 that mounts the resistive heat generator 38 contacts the recess 23*b* depicted in FIG. 9A. The terminals 45 are mounted on the first face of the laminated heater 24.

Figure 10:
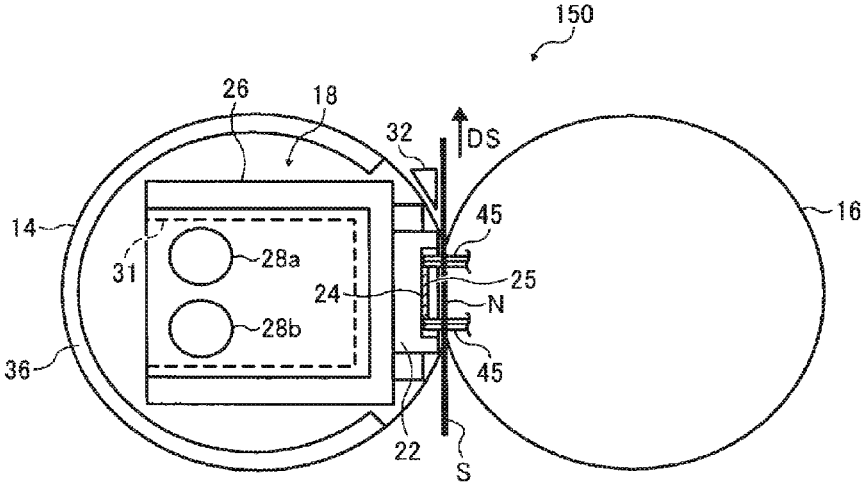
FIG. 10 is a schematic vertical cross-sectional view of the fixing device depicted in FIG. 2 illustrating the laminated heater.

FIG. 10 is a schematic vertical cross-sectional view of the fixing device 150 illustrating the laminated heater 24. As illustrated in FIG. 10, the first face of the laminated heater 24 that mounts the resistive heat generator 38 is isolated from the fixing belt 14. Accordingly, even if the insulative layer 39 depicted in FIG. 8A is broken, power supplied to the laminated heater 24 is not transmitted to the fixing belt 14. If the fixing belt 14 is made of metal as described above, power may be transmitted to other components disposed inside the image forming apparatus 100 through metal of the fixing belt 14, for example, a thermistor contacting the fixing belt 14, thus adversely affecting the thermistor. To address this circumstance, the above-described configuration secures a predetermined interval between the inner circumferential surface of the fixing belt 14 and the resistive heat generator 38 extending along the inner circumferential surface of the fixing belt 14.

As illustrated in FIG. 7, the thermal equalizer 25 is a thin thermal conductor that contacts the fixing nip side face 23*a*, that is, a contact face, of the base 23 that is disposed opposite the fixing belt 14. The thermal equalizer 25 is a copper plate, an aluminum plate, or the like that has an increased thermal conductivity. According to this exemplary embodiment, the thermal equalizer 25 is folded into a recess. Accordingly, the recessed thermal equalizer 25 prevents an edge of the metallic fixing belt 14 from striking the thermal equalizer 25 and causing the thermal equalizer 25 to suffer from excessive abrasion. The thermal equalizer 25 has a thickness in a range of from about 0.3 mm to about 0.5 mm. The thermal equalizer 25 is not rigid and therefore is deformed readily by a load imposed by the pressure roller 16, thus being contoured along an outer circumferential surface of the base 23 and adhered to the base 23.

The thickness of the thermal equalizer 25 changes an amount of heat conducted through the thermal equalizer 25. For example, as the thickness of the thermal equalizer 25 increases, the amount of heat conducted through the thermal equalizer 25 in a plane direction thereof increases, thus eliminating uneven temperature increase of the fixing belt 14 that is uneven between a conveyance span where the sheet S is conveyed over the fixing belt 14 and a non-conveyance span where the sheet S is not conveyed over the fixing belt 14. However, as the thickness of the thermal equalizer 25 increases, the thermal capacity of the thermal equalizer 25 increases, thus increasing a warm-up time and the resuming time taken for the fixing device 150 to resume fixing from the energy saver mode. The warm-up time defines a time taken to warm up the fixing device 150 from an ambient temperature to a predetermined temperature at which printing is available after the image forming apparatus 100 is powered on. Conversely, as the thickness of the thermal equalizer 25 decreases, the warm-up time and the resuming time are shortened. However, the fixing belt 14 does not achieve an even temperature precisely. According to an experiment and an examination, the thermal equalizer 25 may be a copper plate having a thickness in a range of from about 0.3 mm to about 0.5 mm.

Referring to FIGS. 2 and 7, a description is provided of heating processes to heat the fixing belt 14 from an ambient temperature (e.g., a room temperature).

When the image forming apparatus 100 depicted in FIG. 1 receives a print signal, the halogen heaters 28*a* and 28*b* heat a substantially center span of the fixing belt 14 in the axial direction thereof substantially simultaneously. While the halogen heaters 28*a* and 28*b* heat the fixing belt 14, the fixing belt 14 rotates in the rotation direction D14. Accordingly, during an initial heating time when the halogen heaters 28*a* and 28*b* start heating the fixing belt 14, the temperature of the fixing belt 14 varies in a circumferential direction and the axial direction of the fixing belt 14. However, the fixing belt 14 achieves an even temperature by conduction of heat through the fixing belt 14 over time.

On the other hand, when the image forming apparatus 100 receives the print signal, the laminated heater 24 is also energized to generate heat substantially simultaneously. Heat generated by the laminated heater 24 is conducted to the base 23 and the thermal equalizer 25. If the base 23 has an increased thermal conductivity, heat is conducted to a stay side face 23*e* of the base 23 that is opposite the fixing nip side face 23*a*. Thus, the fixing nip side face 23*a* of the base 23 is heated slowly.

Figure 11:
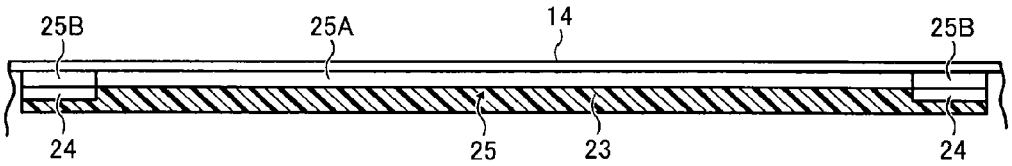
FIG. 11 is a cross-sectional view of the base, the laminated heater, and the thermal equalizer depicted in FIG. 9B illustrating a primary heating span portion and a secondary heating span portion of the thermal equalizer.

To address this circumstance, according to this exemplary embodiment, the thermal equalizer 25 has a construction to achieve different thermal conductivities as illustrated in FIG. 11. FIG. 11 is a cross-sectional view of the base 23, the laminated heater 24, and the thermal equalizer 25 taken along the direction perpendicular to the sheet conveyance direction DS. As illustrated in FIG. 11, the thermal equalizer 25 includes a primary heating span portion 25A spanning the primary heating span S28 depicted in FIG. 6 of the halogen heaters 28*a* and 28*b* and a secondary heating span portion 25B spanning the secondary heating span S24 of the laminated heater 24. A thermal conductivity of the primary heating span portion 25A is smaller than a thermal conductivity of the secondary heating span portion 25B.

In other words, a thermal conductivity of a center span of the thermal equalizer 25 in the axial direction of the fixing belt 14 is different from a thermal conductivity of each lateral end span of the thermal equalizer 25 in the axial direction of the fixing belt 14. Separate components or members may constitute the center span of the thermal equalizer 25 and each lateral end span of the thermal equalizer 25 in the axial direction of the fixing belt 14, respectively. Alternatively, the primary heating span portion 25A disposed at the center span of the thermal equalizer 25 in the axial direction of the fixing belt 14 and the secondary heating span portion 25B disposed at each lateral end span of the thermal equalizer 25 in the axial direction of the fixing belt 14 may be made of an identical material and treated with processing to differentiate the thermal conductivity of the primary heating span portion 25A from the thermal conductivity of the secondary heating span portion 25B.

In addition to difference in thermal conductivity between the primary heating span portion 25A and the secondary heating span portion 25B, the contact area where the laminated heater 24 contacts the thermal equalizer 25 is greater than the contact area where the laminated heater 24 contacts the base 23 as described above to facilitate conduction of heat from the laminated heater 24 to the thermal equalizer 25 contacting the fixing belt 14.

The secondary heating span portion 25B contacting the laminated heater 24 conducts heat to the fixing belt 14 effectively. The primary heating span portion 25A heated by the halogen heaters 28*a* and 28*b* does not absorb heat from the fixing belt 14 unnecessarily even when the thermal equalizer 25 is cool before the fixing device 150 resumes fixing and while a sheet S is conveyed through the fixing device 150 initially in a print job.

Temperature increase of the fixing belt 14 occurs after a certain period of time elapses, resulting in overheating or temperature increase of the non-conveyance span disposed at each lateral end span of the fixing belt 14 in the axial direction thereof after a plurality of sheets S is conveyed over the fixing belt 14 continuously and uneven temperature of the fixing belt 14 at the fixing nip N. Hence, the center span of the thermal equalizer 25 in the axial direction of the fixing belt 14 is not requested to attain a thermal conductivity that is equivalent to a thermal conductivity of a peripheral of the laminated heater 24.

Heat generated by the laminated heaters 24 is conducted to the thermal equalizer 25. Heat generated by the halogen heaters 28*a* and 28*b* is conducted to the thermal equalizer 25 through the fixing belt 14. While the fixing device 150 is warmed up or immediately after the fixing device 150 resumes fixing, no sheet S or a few sheets S are conveyed over the fixing belt 14 and therefore no heat or slight heat is drawn by the sheet S from the fixing belt 14. Accordingly, conduction of heat is suppressed from the fixing belt 14 to the thermal equalizer 25 in the primary heating span S28 heated by the halogen heaters 28*a* and 28*b*. Conversely, conduction of heat is facilitated from the laminated heater 24 to the thermal equalizer 25 in the secondary heating span S24 heated by each laminated heater 24.

Figure 12:
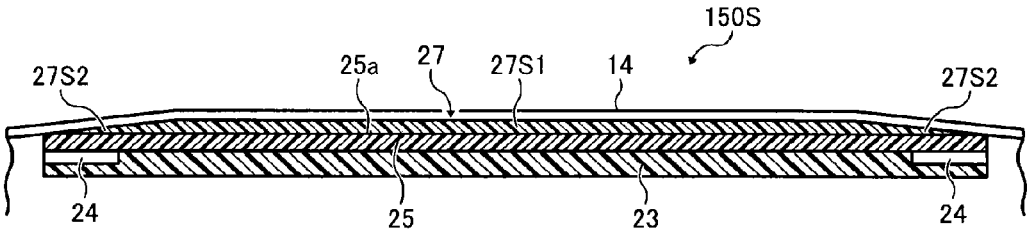
FIG. 12 is a partial cross-sectional view of a fixing device according to a second exemplary embodiment of the present disclosure.
Figure 13A:
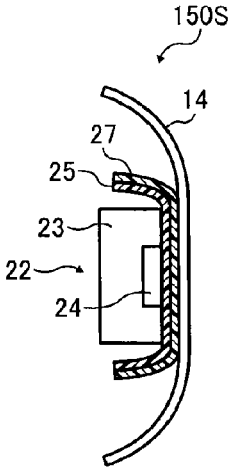
FIG. 13A is a partial vertical cross-sectional view of the fixing device illustrated in FIG. 12.
Figure 13B:
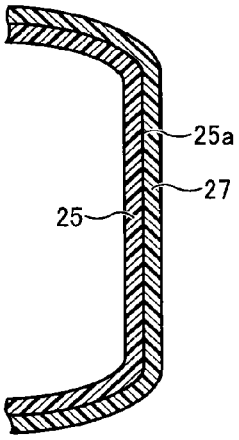
FIG. 13B is a vertical cross-sectional view of the thermal equalizer and a low-conductivity thermal conductor incorporated in the fixing device illustrated in FIG. 12.

Referring to FIGS. 12, 13A, and 13B, a description is provided of a configuration of a fixing device 150S according to a second exemplary embodiment.

The components of the fixing device 150S according to the second exemplary embodiment that are identical to those of the fixing device 150 according to the first exemplary embodiment are assigned with the identical reference numerals and a description of the construction and the configuration mentioned above is omitted.

FIG. 12 is a partial cross-sectional view of the fixing device 150S taken along the direction perpendicular to the sheet conveyance direction DS. As illustrated in FIG. 12, the fixing device 150S includes a low-conductivity thermal conductor 27 serving as a third nip formation portion mounted on the fixing nip side face 25*a* of the thermal equalizer 25. Thus, the low-conductivity thermal conductor 27 is sandwiched between the thermal equalizer 25 and the fixing belt 14. The low-conductivity thermal conductor 27 is associated with the thermal equalizer 25 and made of a thermally resistive material. The low-conductivity thermal conductor 27 is mounted on the fixing nip side face 25*a* of the thermal equalizer 25 as a separate component separately provided from the thermal equalizer 25.

FIG. 13A is a partial vertical cross-sectional view of the fixing device 150S. FIG. 13B is a vertical cross-sectional view of the thermal equalizer 25 and the low-conductivity thermal conductor 27 of the fixing device 150S. As illustrated in FIG. 13B, the low-conductivity thermal conductor 27 may coat the fixing nip side face 25*a* of the thermal equalizer 25 as a film and may be coupled with the thermal equalizer 25, for example.

Since the thermal equalizer 25 contacting the fixing belt 14 directly is requested to achieve heat resistance, a low friction coefficient to facilitate sliding of the fixing belt 14 over the thermal equalizer 25, and resistance against abrasion, the thermal equalizer 25 is made of fluorine resin. If the low-conductivity thermal conductor 27 is made of fluorine resin that facilitates sliding of the fixing belt 14 over the low-conductivity thermal conductor 27, the low-conductivity thermal conductor 27 attains a decreased thermal conductivity compared to the thermal equalizer 25 made of copper, aluminum, or the like, thus also attaining resistance against heat.

As illustrated in FIG. 12, a thickness of a center portion 27S1, serving as a primary heating span portion, of the low-conductivity thermal conductor 27 in a longitudinal direction thereof parallel to the axial direction of the fixing belt 14 is greater than a thickness of each lateral end portion 27S2, serving as a secondary heating span portion, of the low-conductivity thermal conductor 27 in the longitudinal direction thereof that is disposed opposite or in proximity to the laminated heater 24. Accordingly, the fixing device 1505 according to the second exemplary embodiment attains heat conduction equivalent to that of the fixing device 150 according to the first exemplary embodiment. Alternatively, the low-conductivity thermal conductor 27 is made of a material that facilitates sliding of the fixing belt 14 over the low-conductivity thermal conductor 27, for example, polyacetal, polyimide, or the like.

A description is provided of a configuration of the low-conductivity thermal conductor 27 according to a third exemplary embodiment.

The low-conductivity thermal conductor 27 according to the third exemplary embodiment has a uniform thickness throughout the longitudinal direction thereof. A surface roughness of the center portion 27S1, that is, the primary heating span portion, of the low-conductivity thermal conductor 27 is greater than a surface roughness of the lateral end portion 27S2, that is, the secondary heating span portion, of the low-conductivity thermal conductor 27 that is disposed opposite or in proximity to the laminated heater 24. The low-conductivity thermal conductor 27 having the uniform thickness contacts the fixing belt 14 in the primary heating span S28 heated by the halogen heaters 28*a* and 28*b* at a decreased number of points or in a decreased area on the fixing belt 14, reducing conduction of heat from the fixing belt 14 to the low-conductivity thermal conductor 27 and thereby achieving the advantage described above.

A description is provided of a configuration of the base 23 and the thermal equalizer 25 according to a fourth exemplary embodiment.

According to the fourth exemplary embodiment, a thermal conductivity of the base 23 is smaller than a thermal conductivity of the thermal equalizer 25 to decrease conduction of heat in the direction A depicted in FIG. 7. An elastic body, preferably, an elastic body having an increased thermal conductivity, may be sandwiched between the thermal equalizer 25 and the laminated heater 24 to conduct heat from the laminated heater 24 to the thermal equalizer 25 effectively.

Figure 14A:
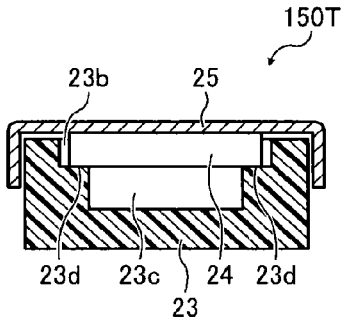
FIG. 14A is a cross-sectional view of a fixing device according to a fifth exemplary embodiment of the present disclosure.
Figure 14B:
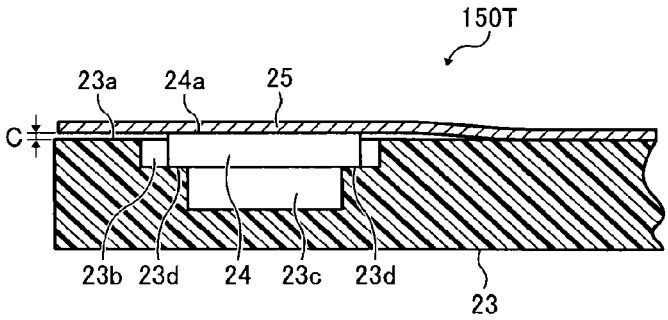
FIG. 14B is a cross-sectional view of the base, the laminated heater, and the thermal equalizer incorporated in the fixing device illustrated in FIG. 14A.

Referring to FIGS. 14A and 14B, a description is provided of a configuration of a fixing device 150T according to a fifth exemplary embodiment.

FIG. 14A is a cross-sectional view of the base 23, the laminated heater 24, and the thermal equalizer 25 taken along the sheet conveyance direction DS. FIG. 14B is a cross-sectional view of the base 23, the laminated heater 24, and the thermal equalizer 25 taken along the direction perpendicular to the sheet conveyance direction DS.

As illustrated in FIG. 14B, according to this exemplary embodiment, the laminated heater 24 projects beyond the fixing nip side face 23*a* of the base 23 that is disposed opposite the pressure roller 16 toward the thermal equalizer 25 by a length C. In other words, a fixing nip side face 24*a* of the laminated heater 24 that contacts the thermal equalizer 25 projects beyond the fixing nip side face 23*a* of the base 23 that is disposed opposite the pressure roller 16 toward the thermal equalizer 25. Accordingly, the thermal equalizer 25 contacts the laminated heater 24 precisely, facilitating conduction of heat in the direction B in FIG. 7. If the fixing nip side face 24*a* of the laminated heater 24 is leveled with the fixing nip side face 23*a* of the base 23 to define an identical plane, the fixing nip side face 24*a* of the laminated heater 24 may be separated from the fixing belt 14 at the fixing nip N farther than the fixing nip side face 23*a* of the base 23 due to design tolerance.

If the fixing nip side face 24*a* of the laminated heater 24 is separated from the fixing belt 14 at the fixing nip N, the fixing belt 14 does not contact the thermal equalizer 25 in a sufficient area, degrading heat conduction and increasing the heating time to heat the fixing belt 14. Additionally, the laminated heater 24 may overheat to a temperature higher than a heat resistant temperature of the base 23, melting the base 23. To address this circumstance, according to this exemplary embodiment, the laminated heater 24 projects toward the thermal equalizer 25 relative to the base 23 to conduct heat generated by the laminated heater 24 to the thermal equalizer 25 precisely even with a manufacturing error.

A description is provided of a construction of a nip formation assembly 63 (e.g., a nip formation unit) as a variation of the nip formation assembly 18 depicted in FIG. 2.

Figure 15:
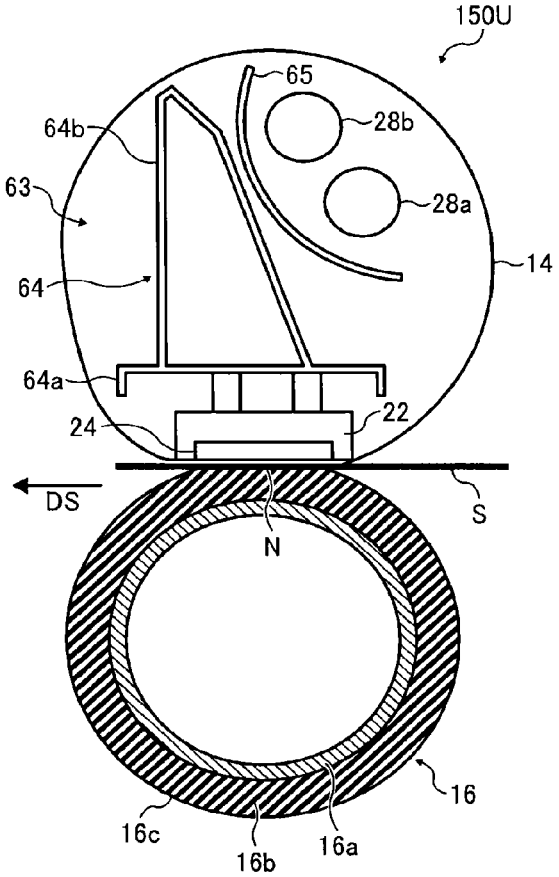
FIG. 15 is a schematic vertical cross-sectional view of a fixing device according to a sixth exemplary embodiment of the present disclosure.

FIG. 15 is a schematic vertical cross-sectional view of a fixing device 150U according to a sixth exemplary embodiment incorporating the nip formation assembly 63. As illustrated in FIG. 15, the nip formation assembly 63 includes the nip formation pad 22, the laminated heaters 24, and a stay 64 that supports the nip formation pad 22 against pressure from the pressure roller 16. The stay 64 includes a base 64*a* and a stand 64*b* coupled with the base 64*a*. The base 64*a* supports the nip formation pad 22 like the stay 26 depicted in FIG. 2. The stand 64*b* is substantially contoured into a triangle in cross-section. The halogen heaters 28*a* and 28*b* serving as a primary heater are interposed between the stand 64*b* of the stay 64 and the fixing belt 14. The halogen heaters 28*a* and 28*b* heat the fixing belt 14 directly with light irradiating the inner circumferential surface of the fixing belt 14, thus heating the fixing belt 14 with radiation heat. An arcuate, platy reflector 65 is interposed between the halogen heaters 28*a* and 28*b* and the stand 64*b* of the stay 64 to reflect light radiated from the halogen heaters 28*a* and 28*b* toward the fixing belt 14 so as to improve heating efficiency of the halogen heaters 28*a* and 28*b* to heat the fixing belt 14.

The nip formation assembly 63 achieves advantages similar to those of the nip formation assembly 18 described above. Alternatively, instead of the reflector 65, an exterior surface of the stand 64*b* may be treated with insulation or mirror finish to reflect light radiated from the halogen heaters 28*a* and 28*b* toward the fixing belt 14. In this case, the halogen heaters 28*a* and 28*b* heat the fixing belt 14 with a slightly decreased heating efficiency compared to a heating efficiency with which the halogen heaters 28*a* and 28*b* heat the fixing belt 14 together with the reflector 65.

The present disclosure is not limited to the details of the exemplary embodiments described above and various modifications and improvements are possible. The advantages achieved by the first to sixth exemplary embodiments are examples and therefore are not limited to those described above.

A description is provided of advantages of the fixing devices 150, 150S, 150T, and 150U.

As illustrated in FIG. 2, a fixing device (e.g., the fixing devices 150, 150S, 150T, and 150U) includes a flexible, endless fixing rotator (e.g., the fixing belt 14) rotatable in a predetermined direction of rotation (e.g., the rotation direction D14); an opposed rotator (e.g., the pressure roller 16) disposed opposite the fixing rotator; a nip formation pad (e.g., the nip formation pad 22), disposed inside a loop formed by the fixing rotator, to press against the opposed rotator via the fixing rotator to form the fixing nip N between the fixing rotator and the opposed rotator, through which a recording medium (e.g., a sheet S) bearing a toner image is conveyed; a primary heater (e.g., the halogen heaters 28*a* and 28*b*), disposed opposite a circumferential span of the fixing rotator other than the fixing nip N in the direction of rotation of the fixing rotator, to heat the fixing rotator; and a secondary heater (e.g., the laminated heater 24), disposed opposite the fixing nip N, to heat the fixing rotator. As illustrated in FIG. 7, the nip formation pad includes a first nip formation portion (e.g., the base 23) and a second nip formation portion (e.g., the thermal equalizer 25) layered on the first nip formation portion and sandwiched between the first nip formation portion and the fixing rotator. The secondary heater is interposed between the first nip formation portion and the second nip formation portion.

As illustrated in FIG. 6, the primary heater is disposed opposite the primary heating span S28 spanning in an axial direction of the fixing rotator. The secondary heater is disposed opposite the secondary heating span S24 spanning in the axial direction of the fixing rotator that is outboard from the primary heating span S28 in the axial direction of the fixing rotator. The secondary heating span S24 is disposed at each lateral end of the fixing rotator in the axial direction thereof. A primary conduction of heat conducted from the primary heating span S28 of the fixing rotator to the nip formation pad is smaller than a secondary conduction of heat conducted from the nip formation pad to the secondary heating span S24 of the fixing rotator. In other words, the secondary heater heats the secondary heating span S24 of the fixing rotator through the nip formation pad from which heat is conducted to the fixing rotator with the secondary conduction greater than the primary conduction with which heat is conducted from the fixing rotator to the nip formation pad.

Accordingly, the fixing device performs fixing on sheets of various sizes while saving energy and suppresses variation in temperature of the fixing rotator that may result in formation of a faulty toner image on the recording medium.

As illustrated in FIGS. 5 and 6, the laminated heaters 24 are disposed opposite both lateral end spans of the fixing belt 14 in the axial direction thereof, respectively, because the fixing device 150 employs a center conveyance system in which the sheet S is centered on the fixing belt 14 in the axial direction thereof. Alternatively, one of the laminated heaters 24 may be eliminated if the fixing device 150 employs a lateral end conveyance system in which the sheet S is conveyed in the sheet conveyance direction DS along one lateral end of the fixing belt 14 in the axial direction thereof. In this case, another one of the laminated heaters 24 is distal from the lateral end of the fixing belt 14 in the axial direction thereof.

According to the exemplary embodiments described above, the fixing belt 14 serves as a fixing rotator. Alternatively, a fixing film, a fixing sleeve, or the like may be used as a fixing rotator. Further, the pressure roller 16 serves as an opposed rotator. Alternatively, a pressure belt or the like may be used as an opposed rotator.

The present disclosure has been described above with reference to specific exemplary embodiments. Note that the present disclosure is not limited to the details of the embodiments described above, but various modifications and enhancements are possible without departing from the spirit and scope of the disclosure. It is therefore to be understood that the present disclosure may be practiced otherwise than as specifically described herein. For example, elements and/or features of different illustrative exemplary embodiments may be combined with each other and/or substituted for each other within the scope of the present disclosure.

What is claimed is:

1. A fixing device comprising:

a flexible fixing rotator rotatable in a predetermined direction of rotation;

an opposed rotator disposed opposite the fixing rotator;

a nip formation pad to press against the opposed rotator via the fixing rotator to form a fixing nip between the fixing rotator and the opposed rotator, the fixing nip through which a recording medium bearing a toner image is conveyed, the nip formation pad including:

a first nip formation portion; and a second nip formation portion layered on the first nip formation portion and sandwiched between the first nip formation portion and the fixing rotator;

a primary heater disposed opposite the fixing rotator in a circumferential span other than the fixing nip in the direction of rotation of the fixing rotator and in a primary heating span spanning in an axial direction of the fixing rotator, the primary heater to heat the primary heating span of the fixing rotator from which heat is conducted to the nip formation pad with a primary conduction; and a secondary heater disposed opposite the fixing rotator in the fixing nip and in a secondary heating span that is outboard from the primary heating span in the axial direction of the fixing rotator, the secondary heater, interposed between the first nip formation portion and the second nip formation portion, to heat the secondary heating span of the fixing rotator through the nip formation pad from which heat is conducted to the fixing rotator with a secondary conduction greater than the primary conduction.

2. The fixing device according to claim 1, wherein the second nip formation portion includes:

a primary heating span portion contacting the primary heating span of the fixing rotator and having a primary thermal conductivity; and a secondary heating span portion contacting the secondary heating span of the fixing rotator and having a secondary thermal conductivity greater than the primary thermal conductivity of the primary heating span portion.

3. The fixing device according to claim 1, wherein the second nip formation portion is made of metal.

4. The fixing device according to claim 3,
wherein the nip formation pad further includes a third nip formation portion being sandwiched between the second nip formation portion and the fixing rotator and having a thermal conductivity smaller than a thermal conductivity of the second nip formation portion.

5. The fixing device according to claim 4,
wherein each of the first nip formation portion and the third nip formation portion is made of resin.

6. The fixing device according to claim 4,
wherein the third nip formation portion includes:
a primary heating span portion disposed opposite the primary heating span of the fixing rotator; and
a secondary heating span portion disposed opposite the secondary heating span of the fixing rotator.

7. The fixing device according to claim 6,
wherein a thickness of the primary heating span portion is greater than a thickness of the secondary heating span portion.

8. The fixing device according to claim 6,
wherein a surface roughness of the primary heating span portion is greater than a surface roughness of the secondary heating span portion.

9. The fixing device according to claim 4,
wherein the third nip formation portion is made of a material that facilitates sliding of the fixing rotator over the third nip formation portion.

10. The fixing device according to claim 1,
wherein a contact area where the secondary heater contacts the second nip formation portion is greater than a contact area where the secondary heater contacts the first nip formation portion.

11. The fixing device according to claim 1,
wherein a thermal conductivity of the first nip formation portion is smaller than a thermal conductivity of the second nip formation portion.

12. The fixing device according to claim 1,
wherein the first nip formation portion includes a recess accommodating the secondary heater.

13. The fixing device according to claim 12,
wherein the secondary heater includes a fixing nip side face contacting the second nip formation portion and projecting beyond the first nip formation portion toward the second nip formation portion.

14. The fixing device according to claim 12,
wherein the first nip formation portion further includes:
a cavity adjoining the recess; and
a heater bearing defining the cavity.

15. The fixing device according to claim 14,
wherein the secondary heater includes an outer marginal portion supported by the heater bearing.

16. The fixing device according to claim 1,
wherein the primary heating span is a center span of the fixing rotator in the axial direction of the fixing rotator and the secondary heating span is each lateral end span of the fixing rotator in the axial direction of the fixing rotator.

17. The fixing device according to claim 1,
wherein the fixing rotator includes an endless belt.

18. The fixing device according to claim 1,
wherein the primary heater includes a halogen heater and the secondary heater includes a laminated heater.

19. The fixing device according to claim 1,
wherein the second nip formation portion includes a thermal equalizer.

20. An image forming apparatus comprising:
an image bearer to bear a toner image; and
a fixing device disposed downstream from the image bearer in a recording medium conveyance direction to fix the toner image on a recording medium,
the fixing device including:
a flexible fixing rotator rotatable in a predetermined direction of rotation;
an opposed rotator disposed opposite the fixing rotator;
a nip formation pad to press against the opposed rotator via the fixing rotator to form a fixing nip between the fixing rotator and the opposed rotator, the fixing nip through which the recording medium bearing the toner image is conveyed,
the nip formation pad including:
a first nip formation portion; and
a second nip formation portion layered on the first nip formation portion and sandwiched between the first nip formation portion and the fixing rotator;
a primary heater disposed opposite the fixing rotator in a circumferential span other than the fixing nip in the direction of rotation of the fixing rotator and in a primary heating span spanning in an axial direction of the fixing rotator, the primary heater to heat the primary heating span of the fixing rotator from which heat is conducted to the nip formation pad with a primary conduction; and
a secondary heater disposed opposite the fixing rotator in the fixing nip and in a secondary heating span that is outboard from the primary heating span in the axial direction of the fixing rotator, the secondary heater, interposed between the first nip formation portion and the second nip formation portion, to heat the secondary heating span of the fixing rotator through the nip formation pad from which heat is conducted to the fixing rotator with a secondary conduction greater than the primary conduction.

* * * * *